United States Patent [19]

Cheever

[11] Patent Number: 4,631,444

[45] Date of Patent: Dec. 23, 1986

[54] READILY ATTACHABLE AND DETACHABLE ELECTRON-BEAM PERMEABLE WINDOW ASSEMBLY

[75] Inventor: Richard N. Cheever, Acton, Mass.

[73] Assignee: Tetra Pak Developpement SA, Lausanne, Switzerland

[21] Appl. No.: 831,070

[22] Filed: Feb. 20, 1986

Related U.S. Application Data

[63] Continuation of Ser. No. 427,903, Sep. 29, 1982, abandoned.

[51] Int. Cl.[4] ..... H01J 33/04; G21G 1/12

[52] U.S. Cl. ..... 313/420; 250/492.3

[58] Field of Search ..... 313/420, 237, 236; 328/233; 250/503.1, 505.1, 491.1, 492.1, 492.3; 378/140

[56] References Cited

U.S. PATENT DOCUMENTS 4,112,307 9/1978 Föll et al. ..... 250/505.1

4,461,972 7/1984 Dmitriev et al. ..... 313/420

*Primary Examiner*—Palmer C. DeMeo

*Assistant Examiner*—Sandra L. O'Shea

*Attorney, Agent, or Firm*—Rines and Rines, Shapiro and Shapiro

[57] ABSTRACT

This disclosure involves an electron-beam permeable window assembly or cassette mounted in a frame readily insertable and removable from an electron-beam generator housing and, upon insertion, sealable thereto and to pathways carrying materials to be electron-beam irradiated through the window.

5 Claims, 1 Drawing Figure

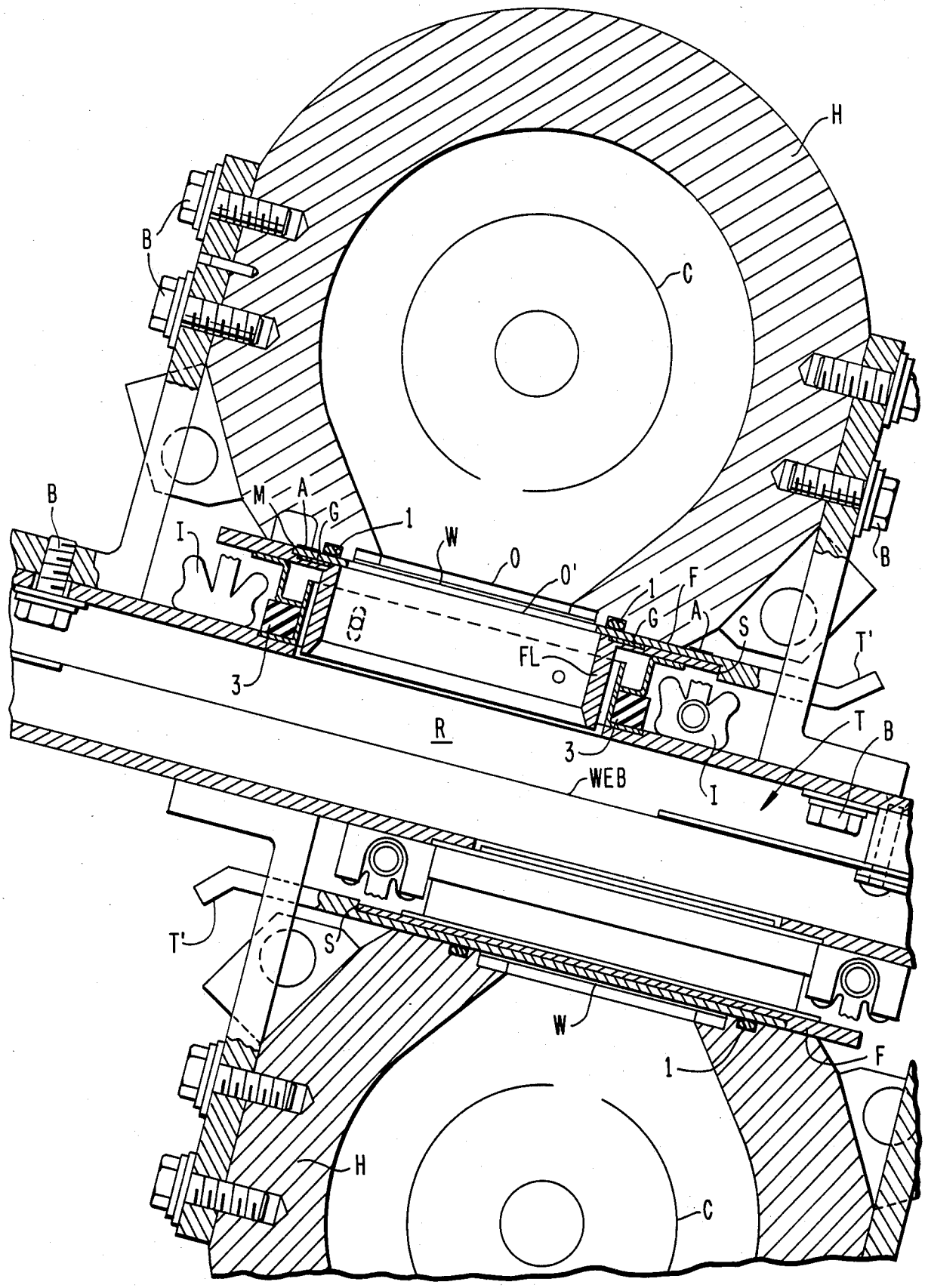
H
C
B
B
M
A
G
1
I
W
O
O'
1
F
G
A
S
T'
FL
3
R
3
T
B
WEB
I
T'
S
W
1
F
H
C

READILY ATTACHABLE AND DETACHABLE ELECTRON-BEAM PERMEABLE WINDOW ASSEMBLY

This is a continuation application of Ser. No. 427,903, filed Sept. 29, 1982 now abandoned.

The present invention relates to electron beam structures and more particularly to those structures involving electron beam permeable windows as of thin metal foil and the like; being directed to improvements in enabling the more facile and fast replacement of such window structures as the electron beam irradiation exit for evacuated electron beam generator housings and the like.

The problem of damage in use and ultimate wear and burning of the thin electron beam pervious foil windows utilized in electron beam generator apparatus and the like has plagued the art for some time, and has given rise to all kinds of proposed solutions to the problem including the utilization of supporting structures as described, for example, in U.S. Pat. No. 3,440,,466, and the use of stronger or more durable alloys and the like.

In accordance with the present invention, a different approach to the problem has been taken in providing for the ready attachment and detachment of relatively inexpensive and rapidly replaceable electron beam window assemblies in the form of pre-prepared and easily employed frames or cassettes that can be removed or installed with vacuum and gas seals in very short periods of time.

An object of the invention, therefore, is to provide a novel readily attachable and detachable electron beam permeable window assembly that obviates in large part the practical problems residing in the replacement of conventional windows and the above-described disadvantages attendant upon the same.

A further object is to provide a novel electron beam window assembly of more general utility as well.

Other and further objects are explained hereinafter and are more particularly delineated in the appended claims.

In summary, however, from one of its important points of view, the invention embraces a readily attachable and detachable electron-beam permeable window assembly having, in combination, a frame defining an internal opening; a thin electron-beam permeable window overlying the opening and secured near its margin to one side of the frame with a peripheral region supported by the frame but inward of the margin against which a peripheral sealing ring of an electron beam housing wall may be compressed; tab means extending beyond the frame to permit insertion and removal of the same from the sealing ring; flange means supporting the frame on its side opposite the window; and locking means cooperative with the flange means to enable inactivation of the locking means to insert or withdraw the frame by the tab means to or from a position under the sealing ring, activation of the locking means causing locking force to be exerted against the flange means to seal the window to the sealing ring. Preferred and best mode structural details are hereinafter presented.

As described in my eariler U.S. Pat. No. 4,305,000 and in other U.S. Pat. Nos. 4,252,413 and 3,702,412, 3,745,396 and 3,769,600, exit for electron-beam generators is generally a titanium or aluminum thin window or composites of the same or similar materials. In applications where the electron beam generator is subject to chemical attack, as where it is being used in an environment where hydrogen peroxide or other sterilization vapors are involved, the thin window may have to be replaced on a relatively frequent schedule, which is a serious problem in production operation. The corrosion from the vapors weakens the windows and, of course, they fail. Other catastrophes occur with windows as of aluminum, for example, where the moist air products, such as nitric acid, are generated and also corrode or attack the window. Titanium windows are subject to the hydrogen peroxide or other vapor attacks. No windows currently last long periods of time, but for one reason or another perforate from the corrosion effects. While composite metals i.e. noble metal overlays may be employed in some instances, there may be presently economically out of the question for production equipment. As before stated, the present invention ameliorates the problem of the costly and time-consuming replacement of windows in conventional fashion by proviing a novel readily attachable and detachable electron-beam permeable window assembly or cassette that enables rapid replacement of windows, say every few weeks for aluminum, or even every day, and by relatively unskilled individuals. This concept means that the present and past constructions involving conventional bolted flanges for the windows may be discarded. This is not only time-consuming, but it certainly is not adaptable for the concept of a quick release or readily detachable or attachable construction. A second requirement is that the window assembly should be fool-proof in the handling of the thin fine foil, both in terms of the user not touching the foil to damage the same and also in terms of the assembly being self-locating to lock-seal in the housing exit region against resilient O-rings or the like with no question of error in insertion or removal, and without the necessity for fine adjustment.

The invention will now be described in connection with the accompanying drawing illustrating a best mode of utilization of the same and in which the single FIGURE is a longitudinal cross section of the invention in preferred form.

Referring to the drawing, a pair of longitudinally spaced opposed normally evacuated electron-beam housings H are shown assembled for purposes of irradiating opposite sides of a web, so-labelled, or materials carried thereby passing longitudinally along a tunnel T. Each housing H supports within its interior the electron-emitting cathode C, as of the types described in said U.S. Pat. Nos. or of other conventional types, and is shown provided with an exit region at the bottom (or top for the lower unit) at which there is an opening O over which the electron-beam permeable thin metal window W is to be sealed. This sealing is effected against resilient marginal O-rings designated at 1 and peripherally clamping against the window W and holding it in sealed assembly. The thin electron beam window W, in accordance with the invention, overlies an opening O' in a rectangular frame F that supports the thin window over the opening O', with the window W resting on the upper side of the frame F (referring illustratively to the upper unit) and secured thereto near outer margins as at M by a thin layer of adhesive or tape A. The margins are outside the region where the sealing ring 1 will ultimately clamp against the window W, such that a peripheral region supported by the frame is provided against which the sealing rings 1 will ultimately bear, this being inward of the sealing near the margin of the window. Further in accordance with the invention, tab means or other handle means T' is provided extending beyond the frame F to permit the user to handle the frame assembly without touching the window and to be able to insert and remove the same from under the sealing ring 1.

Below the frame F, on the opposite side from the window W, is shown a peripheral flange FL which supports the frame assembly on the side opposite the window, and this bears against the outer wall of the tunnel T bounding a pathway or region R through which the article or material to be sterilized or otherwise electron-beam-irradiated for other purposes, labelled "Web", is passed. As shown, the housing H is bolted to the tunnel conduit at B so that the two form a single structural unit. Between the flange FL and the upper surface of the pathway R there is shown a locking means in the form of an inflatable resilient ballon I which, when inflated, bears against the under side of the flange FL and forces the frame F carrying the window W against the sealing ring 1.

In operation, the user inserts the assembly or cassette comprising the window W carried by the frame F by the tab T', with the locking mechanism I deflated or inactivated; and the same is pushed in, stopping as a result of a limit stop S on the tab T' engaging the outer edge of the flange FL, providing for positive location in just the right position. Inflation or activation of the locking mechanism I will then force the flange FL and thus the frame F and window W up against the sealing ring 1 and effect the desired seal to the housing H, whereupon the housing may again be evacuated and operation may continue with the replaced window. Sponge rubber resilient seals 3 adjacent to the lock-sealing ballon I and between flange FL and tunnel T are shown provided to seal the cassette in the wall of the tunnel T against leakage of ozone. The frame F depresses the seals 3 to permit insertion and removal of the window assembly. If desired, a cam (not shown) at either transverse end could be employed and rotated to assist in this depression step. In operation, as before stated, upon the deflation of the locking member I, one depresses the seals 3 with the frame assembly or cassette to remove the cassette, as for replacement by another cassette.

Typical dimensions for a suitable frame and window operable with electron beam energy in the range of 150 KEV, more or less, for such purposes as sterilizing packaging or the like, are 40 cm. by 15 cm. with a 12 micrometer titanium window foil W.

The effective loading or quick-release resilient action attained by the structure I can, of course, be obtained with springs or cams or similar mechanisms, though the best mode embodiment illustrated appears to have considerable advantages for these particular applications.

Further modifications will occur to those skilled in this art and such are considered to fall within the spirit and scope of the invention as defined in the appended claims.

What is claimed is:

1. A readily attachable and detachable electron-beam permeable window assembly having, in combination, a frame defining an internal opening; a thin electron-beam permeable window overlying the opening and having a marginal region secured to one side of the frame and a peripheral region supported by the frame laterally inward of the marginal region and against which a peripheral sealing ring around an opening in an electron beam housing may be compressed; tab means extending laterally outward from the frame and fixed thereto to permit lateral insertion and removal of the frame from the sealing ring; flange means for supporting the frame on its side opposite the window, with the opening in the frame aligned with the opening in the housing, the flange means being positioned relative to the sealing ring to provide a space therebetween into which the frame may be laterally inserted or from which the frame may be laterally withdrawn by said tab means; and locking means cooperative with the flange means and adapted when inactivated to permit the lateral insertion or withdrawal of the frame by the tab means into or from said space, and adapted when activated to cause locking force to be exerted against the flange means to seal the window to the sealing ring, said locking means comprising inflatable resilient means disposed adjacent the flange means.

2. A readily attachable and detachable electron-beam permeable window assembly as claimed in claim 1 and in which stop means is provided for limiting the position of insertion of the assembly.

3. A readily attachable and detachable electron-beam permeable window assembly as claimed in claim 1 provided with means for sealing the same in the wall of an irradiation tunnel receiving material to be electron-beam irradiated at the region of the window.

4. A readily attachable and detachable electron-beam permeable window assembly as claimed in claim 3 disposed to irradiate one side of said material in the tunnel, and a similar window assembly for a similar electron beam housing sealed in an opposite wall of the tunnel to irradiate the opposite side of said material at a region displaced along the tunnel from the first-named window assembly.

5. A readily attachable and detachable electron-beam permeable window assembly having, in combination, a frame defining an internal opening; a thin electron-beam permeable window overlying the opening and having a marginal region secured to one side of the frame and a peripheral region supported by the frame laterally inward of the marginal region and against which a peripheral sealing ring around an opening in an electron beam housing may be compressed; tab means extending laterally outward from the frame and fixed thereto to permit lateral insertion and removal of the frame from the sealing ring; flange means for supporting the frame on its side opposite the window, with the opening in the frame aligned with the opening in the housing, the flange means being positioned relative to the sealing ring to provide a space therebetween into which the frame may be laterally inserted or from which the frame may be laterally withdrawn by said tab means, the flange means being resiliently urged toward the sealing ring; and locking means cooperative with the flange means and adapted when inactivated to permit the lateral insertion or withdrawal of the frame by the tab means into or from said space, and adapted when activated to cause locking force to be exerted against the flange means to seal the window to the sealing ring.

* * * * *